United States Patent [19]

Knudsen

[11] Patent Number: 4,964,393

[45] Date of Patent: Oct. 23, 1990

[54] PROTECTIVE SHIELD FOR STOVE

[76] Inventor: Michael J. Knudsen, 32918 Illinois, Livonia, Mich. 48150

[21] Appl. No.: 494,311

[22] Filed: Mar. 16, 1990

[51] Int. Cl.[5] ..... F24C 15/10

[52] U.S. Cl. ..... 126/211; 126/214 D; 126/201

[58] Field of Search ..... 126/214 D, 211, 201, 126/42

[56] References Cited

U.S. PATENT DOCUMENTS

| | | | |
|---|---|---|---|
| 3,319,620 | 5/1967 | Nazzaro | 126/211 |
| 3,513,826 | 5/1970 | Hellmuth | 126/211 |
| 4,155,343 | 5/1979 | Hartman | 126/211 |
| 4,157,705 | 6/1979 | Caan | 126/214 D |
| 4,517,955 | 5/1985 | Ehrlich et al. | 126/211 |

FOREIGN PATENT DOCUMENTS

| | | | |
|---|---|---|---|
| 924944 | 5/1963 | United Kingdom | 126/211 |
| 2188414 | 9/1987 | United Kingdom | 126/201 |

*Primary Examiner*—Carroll B. Dority
*Attorney, Agent, or Firm*—Charles W. Chandler

[57] ABSTRACT

A shield attachable to a cooking stove to prevent small children from reaching surface burner units or hot cooking containers on the stove top surface. The shield includes an upstanding panel spaced forwardly from the stove and two horizontal plates extending from the lower edge of the panel into a door clearance space along the upper edge of an oven access opening. Screws can be extended through slots in these horizontal plates to rigidly mount the protective shield on the stove.

7 Claims, 3 Drawing Sheets

PROTECTIVE SHIELD FOR STOVE

BACKGROUND AND SUMMARY OF THE INVENTION

This invention relates to protective shields usable on conventional cooking stoves to prevent small children from reaching the stove burners or cooking containers located on the burners. The general aim is to prevent small children from burning themselves, either through direct hand contact with the burners or through a process of pulling a heated container off of the stove.

Protective shields have already been proposed U.S. Pat. No. 4,517,955 to C. Ehrlich shows a shield positionable at the front edge of a stove to prevent small children from reaching the stove burners. The shield is held onto the stove by means of permanent magnets or by clamping bars having hooked ends engageable on edge areas of burner openings in the stove top wall.

The attachment methods disclosed in U.S. Pat. No. 4,517,955 are believed to be disadvantageous in some respects. Permanent magnets may not always be fully resistive to pulling forces exerted by small children on the shield. The use of clamping bars tends to restrict full usage of the stove in that the bars occupy stove counter space that could otherwise be used to support cooking containers. Also the attachment devices shown in U.S. Pat. No. 4,517,955 are relatively complex. They may not be cost effective from a marketing standpoint.

The present invention contemplates a relatively low cost shield construction that is rigidly and firmly attachable to a conventional stove. The shield structure may be removed from the stove when necessary, e.g., should the homeowner sell or discard the stove, or when there are no longer any small children in the home. The shield construction is spaced from the stove surface, such that it does not tend to heat up (due to heat conduction from the stove surface).

In devising my invention, I noticed that conventional stove-oven units of the free-standing type or built-in type, have at least two attachment screws for connecting the oven to a reversely turned flange on the stove front wall. I have concluded that these attachment screws can be effectively used as devices for mounting a protective shield in front of the stove-oven unit.

A preferred form of my invention comprises an upstanding panel adapted to assume an upright position in front of a stove. The panel has sufficient horizontal length that it can span substantially the entire width of the stove. The upper edge of the upright panel is located two or more inches above the plane of the stove top wall. The lower edge of the upright panel is located approximately at the same level as the upper edge of the oven opening.

The upright panel is attached to the stove by means of two L-shaped brackets located at opposite ends of the panel. Each bracket includes a horizontal leg (plate) that extends from the lower edge of the panel into overlapment with flanged areas at the stove-oven interface. Slots in the horizontal legs of the brackets accommodate the aforementioned attachment screws, thereby rigidly attaching the shield to the stove structure. The shield can be removed from the stove by temporarily unscrewing the attachment screws.

THE DRAWINGS

DESCRIPTION OF A PREFERRED FORM OF THE INVENTION

Figure 1:
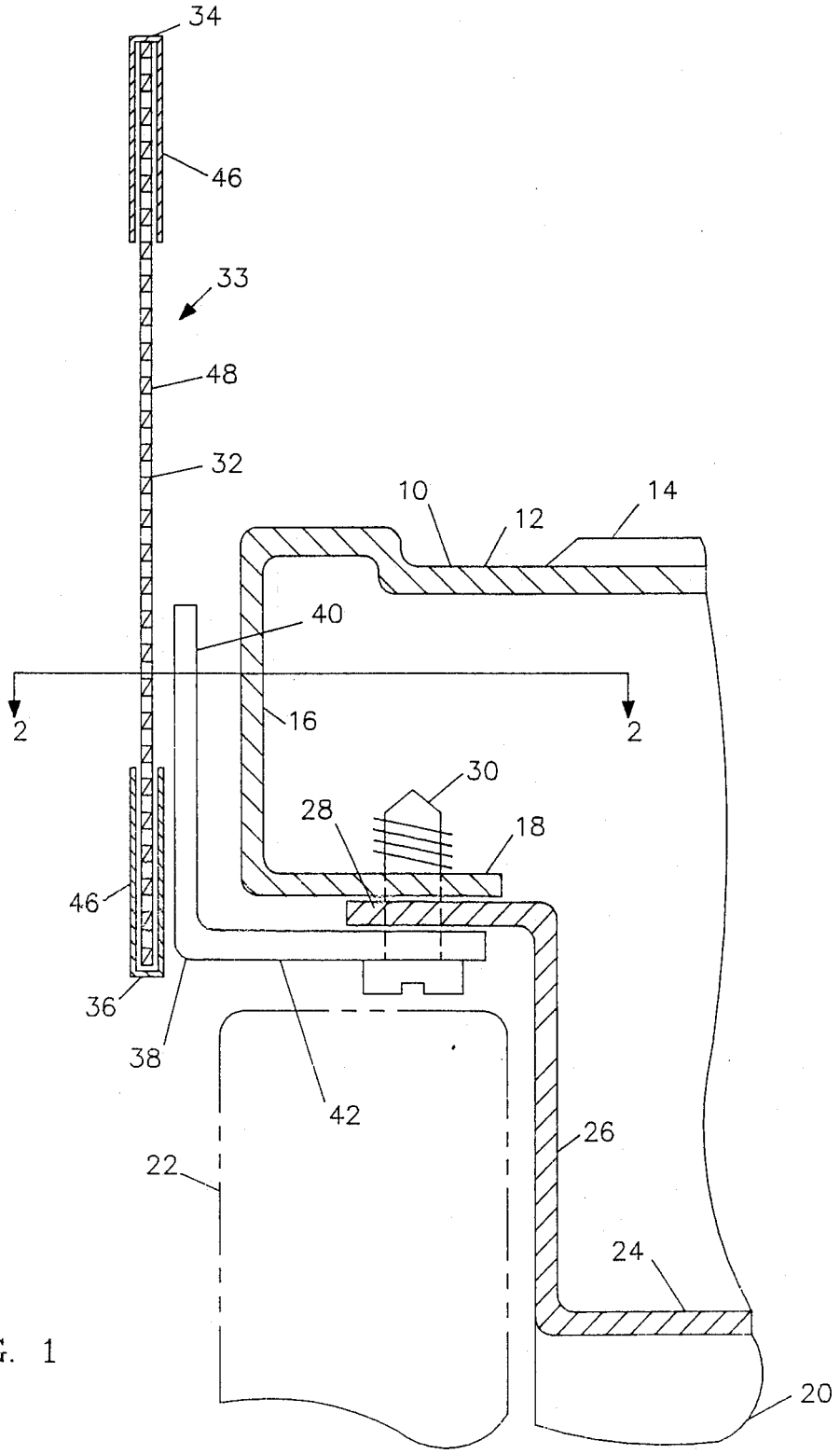
FIG. 1 is a fragmentary sectional view taken through a stove having a shield of the present invention installed thereon.

FIG. 1 fragmentarily shows a conventional cooking stove 10 comprising a top wall 12 that contains (supports) a plural number of surface burner units, one of which is partially shown at 14 in FIG. 1. The stove further includes a front wall 16 extending downwardly from top wall 12, and a rearwardly extending flange 18 connected to the lower edge of wall 16.

The stove includes an oven, referenced generally by numeral 20. A swing-down door 22 (shown fragmentarily in dashed lines) is adapted to close the front access opening of the oven. The oven is defined partially by a horizontal roof wall 24. An integral front wall 26 circumscribes the front access opening of the oven. At its upper edge, the oven front wall has a forwardly-extending flange 28. This flange extends the full width of the stove. Typically, stoves have widths of approximately thirty inches, or thirty-six inches. Larger size stoves can be forty-eight inches in width. Whatever the size of the stove, flanges 28 and 18 will extend the full width of the stove.

Under conventional practice, the two overlapped flanges 18 and 28 are mechanically connected together by a plurality of self-tapping screws 30 extending through aligned circular holes in the flanges. FIG. 1 shows one screw 30. However, in practice there are usually at least four such screws spaced along the two overlapped flanges. Two of these screws will be located near the opposite ends of flanges 18 and 28, i.e., near the stove side walls. In the practice of my invention, I use these two endmost screws to rigidly attach (mount) my protective shield construction to the stove.

The shield construction 33 shown in FIG. 1 comprises an upstanding panel 32 having its upper edge 34 located at least two inches above the general plane of stove top wall 12. Preferably the vertical dimension of the panel is such that the panel upper edge is between two and four inches above the plane of the stove top wall.

Cooking containers are commonly constructed with their handles about two or three inches above the container bottom wall. However, in some cases, the handle is as much as five inches above the container bottom wall. Shield 33 is preferably constructed and oriented so that its upper edge 34 is between two and four inches above the stove top wall, such that the homeowner tends to place cooking containers on the stove so that their handles do not extend across or beyond the shield. If the height of the shield is too great, the shield will be an obstruction to movement and manipulation of the containers. A shield projection of two to four inches is considered to be a satisfactory compromise.

Panel 32 has a horizontal length dimension approximating the full width dimension of the stove, e.g., thirty inches or thirty-six inches, such that the panel provides a full measure of protection against small children reaching up to touch one of the surface burner units or a heated cooking container located on one of the burner units. Panel 32 has its lower edge 36 in approximately horizontal alignment with the overlapped flanges 18 and 28.

Figure 2:
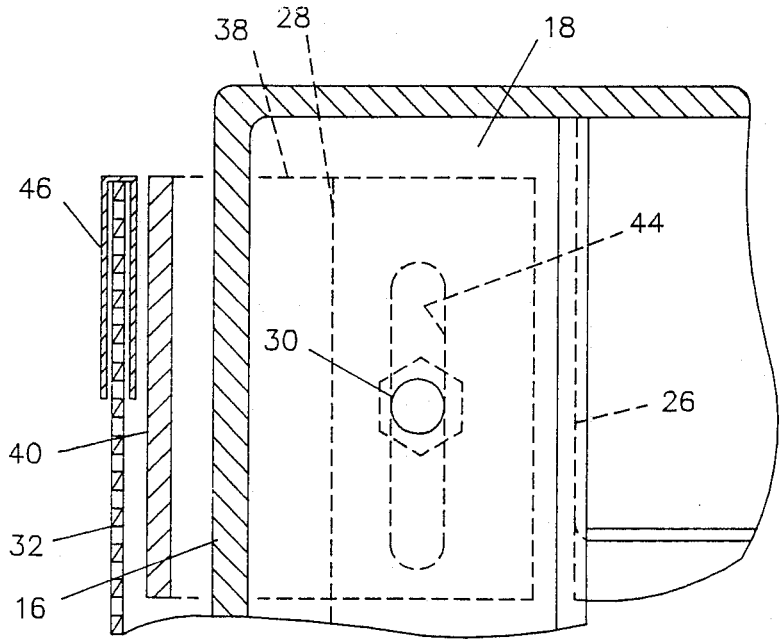
FIG. 2 is a fragmentary sectional view taken on line 2—2 in FIG. 1.

Panel 32 is attachable to the stove by means of two L-shaped brackets 38, only one of which is shown in the drawings. The illustrated bracket 38 is located at or very near an end edge of panel 32, as shown in FIG. 2. The other mounting bracket is located at the opposite end of the panel. Each mounting bracket includes a vertical leg facially engaged with the rear face of panel 32. The bracket can be welded or riveted to the panel.

Each mounting bracket further includes a horizontal leg 42 that forms a flat plate engageable on the underface of flange 28. An elongated slot 44 extends through leg (plate) 42 to accommodate the shank portion of one of the attachment screws 30. Slots 44 extend in the transverse direction, i.e., parallel to the general plane of panel 32, as viewed in FIG. 2. The use of slots 44, rather than circular holes, is advantageous in that slight variations in the spacing of the two attachment screws 30 can thereby be compensated for (taken into account). Each slot 44 is preferably at least one inch in length.

The use of L-shaped brackets 38 is advantageous in that horizontal plate (leg) 42 has a relatively small thickness, e.g., only about one-sixteenth of an inch. Very little vertical space is used within the oven door opening, such that the door can be opened and closed freely without interference from brackets 38. The door mounting does not have to be adjusted or changed.

Brackets 38 have relatively limited surface area contact with oven flange 28. Therefore, any heat generated in the stove tip wall 12 (by burner units 14) will not be conducted into panel 32. The child can touch panel 32 without danger of being burned.

Panel 32 is preferably a rigid panel structure that is optically transparent (such that the homeowner can see through the panel to view cooking containers on the stove). The panel shown in FIGS. 1 and 2 comprises a rectangular frame 46 that forms the border (edges) of the panel. A sheet of expanded metal 48 is mounted within frame 46, such that the frame completely encloses (encircles) edge areas of the sheet.

As shown in the drawings, frame 46 has a U-shaped cross section, comprised of a thin web and two relatively long length flanges. At corner areas of the frame the flanges are mitered to form continuous faces on (around) the frame. Expanded metal sheet 48 preferably has a relatively small hole dimension. Each hole (pore) is only about one-sixteenth inch in size, with the intervening walls being similarly sized. Typically, sheet 48 has the optical characteristics of conventional window screen.

As an alternate to the expanded sheet metal 48, the panel can utilize a transparent plastic sheet of material within rectangular frame 46.

Figure 3:
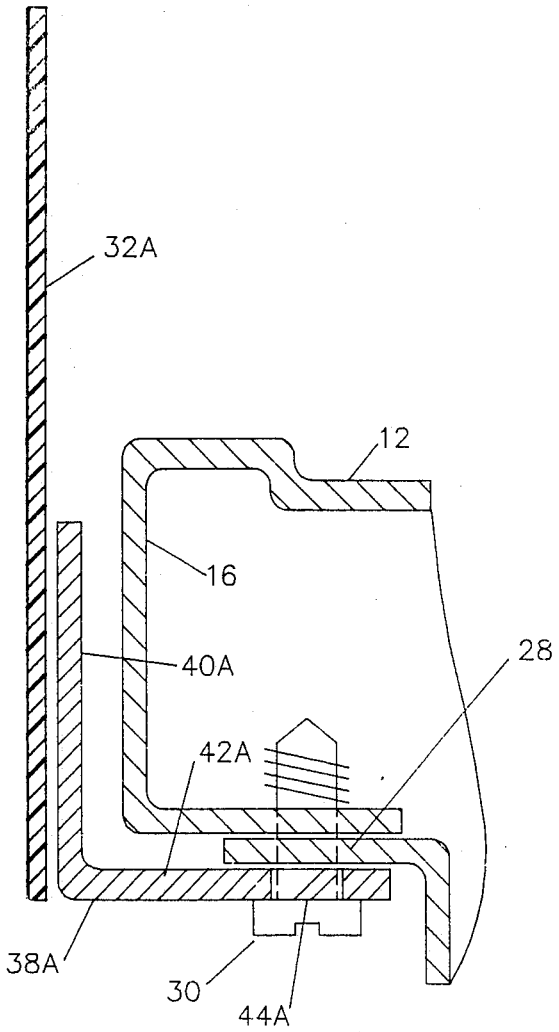
FIG. 3 is a view taken in the same direction as FIG. 1, but illustrating another form that the invention can take.

FIG. 3 illustrates a somewhat simplified form of the invention (compared to FIG. 1). In the FIG. 3 arrangement, a protective panel 32A consists of a single sheet of transparent plastic material. Extending along the lower edge of plastic sheet 32A is an elongated angle member 38A, preferably formed of aluminum or other rigid material. The base of sheet 32A could also be bent to form a pair of L-shaped feet for supporting the upright part of the sheet. Angle member 38A extends the full width of panel 32A so as to act as a reinforcement for the panel.

Horizontal leg 42A of bracket 38A has two slots 44A therethrough at zones near opposite ends of the bracket. The preexisting attachment screws 30 will extend through these slots to rigidly mount the shield construction on the stove.

Either form of the invention can be manufactured at relatively low cost. In each case, panel 32 or 32A is rigidly attached to the stove by two widely spaced screws, such that the panel has a firm rigid mounting on the stove. A child will not be able to pull the panel away from its mounted position on the stove.

The protective panel is spaced forwardly from the stove, such that the entire top surface of the stove is usable for supporting cooking containers, e.g., frying pans, pots, etc.

The panel can be provided in a color matching or complementary the stove color.

The drawings necessarily show specific forms that the invention can take. It will be appreciated that the invention can be practiced in other forms.

I claim:

1. In a cooking stove comprising a top wall; a plural number of burners on said top wall; a front wall extending downwardly from said top wall, said front wall having a rearwardly extending flange thereon; an oven within the stove below said top wall; said oven comprising a roof wall, and a front wall extending upwardly from said roof wall; said oven front wall having a forwardly extending flange thereon extending along said rearwardly extending flange so that said flanges overlap one another; said flanges having at least two sets of aligned holes spaced therealong: the improvement comprising a protective shield adapted to assume an upright position in front of the front wall, to thereby prevent small children from reaching the stove burners or cooking containers on the burners; said protective shield comprising an upstanding panel spanning substantially the entire width dimension of the stove in front of the stove front wall; said panel having a lower edge in approximate horizontal alignment with said overlapped flanges, said panel having an upper edge located at least two inches above the plane of the stove top wall, such that small children are precluded from direct hand access to the burners or items located on the stove top wall; and a panel-mounting means comprising a horizontal plate means extending horizontally from the panel at its lower edge; said horizontal plate means having slots therethrough extending parallel to the plane of the upstanding panel; said slots having a similar spacing to the spacing of the aligned sets of holes, whereby said slots are enabled to overlap respective ones of the holes; and screw fasteners extending through the horizontal plate means and the aligned holes to rigidly affix the shield to the stove.

2. The improvement of claim 1, wherein said upright panel is optically transparent, whereby persons standing away from the stove can see cooking containers on the stove burners.

3. The improvement of claim 2, wherein said panel comprises a rectangular frame defining the panel edges, and a sheet of optically transparent material mounted within said frame.

4. The improvement of claim 3, wherein said optically transparent sheet is formed of expanded metal having a multiplicity of closely spaced holes therethrough.

5. The improvement of claim 4, wherein said rectangular frame has a U-cross section.

6. The improvement of claim 1, therein said panel-mounting means comprises two L-shaped brackets located at opposite ends of the panel, each bracket having a vertical leg facially engaged with the panel and a horizontal leg that defines said horizontal plate means; each bracket having a slot extending through its horizontal leg for coaction with one of the aforementioned screw fasteners.

7. The improvement of claim 6, wherein each slot has a length of at least one inch.

* * * * *